United States Patent [19]

Duyckinck

[11] Patent Number: 4,600,156

[45] Date of Patent: Jul. 15, 1986

[54] CARBON BLACK MILL

[76] Inventor: Robert W. Duyckinck, 187 Commonwealth Ave., New Providence, N.J. 07974

[21] Appl. No.: 589,130

[22] Filed: Mar. 13, 1984

[51] Int. Cl.[4] ..... B02C 13/282

[52] U.S. Cl. ..... 241/56; 241/82; 241/188 R; 241/189 R

[58] Field of Search ..... 241/56, 57, 58, 79, 241/82, 188 R, 189 R, 189 A

[56] References Cited

U.S. PATENT DOCUMENTS

| | | | |
|---|---|---|---|
| 1,673,465 | 6/1928 | McLaughlin et al. | 241/186.2 |
| 2,039,264 | 4/1936 | Seckendorff | 241/56 |
| 2,212,482 | 8/1940 | Sheldon . | |
| 2,226,330 | 12/1940 | Symons . | |
| 2,253,733 | 8/1941 | Sheldon | 241/89.3 |
| 2,316,124 | 4/1943 | Sheldon . | |
| 2,319,192 | 5/1943 | Sheldon | 241/186 |
| 2,543,599 | 2/1951 | Rietz | 241/88 |
| 2,588,434 | 7/1952 | Unti et al. . | |
| 2,644,644 | 7/1953 | West . | |
| 2,706,088 | 4/1955 | Paul | 241/186 |
| 2,957,633 | 10/1960 | Andrews | 241/186.2 X |
| 3,037,712 | 6/1962 | Hosokawa et al. | 241/56 |
| 3,285,523 | 11/1966 | Duyckinck et al. . | |
| 3,333,777 | 8/1967 | Highfill, Jr. et al. . | |
| 4,088,273 | 5/1978 | Jakobs | 241/35 |

FOREIGN PATENT DOCUMENTS

| | | | |
|---|---|---|---|
| 637713 | 6/1937 | Fed. Rep. of Germany | 241/82 |

OTHER PUBLICATIONS

Brochure by Pulverizing Machinery Division of Mikropul Corporation, entitled 1 ACM Mikro-Pulverizer, undated.

*Primary Examiner*—Howard N. Goldberg
*Assistant Examiner*—Timothy V. Eley

[57] ABSTRACT

This invention relates to an apparatus for enhancing the fineness of oversized particulate matter entrained in a gas stream by impact with rapidly rotating hammer surfaces and more particularly to an apparatus for reducing the size of minor fractions of oversized particulates entrained in a gas borne stream of particulates, such as carbon black or the like.

6 Claims, 4 Drawing Figures

CARBON BLACK MILL

BACKGROUND OF THE INVENTION

Impact pulverization of particulate matter has long been conventionally effected by impaction techniques in apparatus generally delineated as "hammer mills". Such "hammer mills", while of widely varying construction and nomenclature, normally employ a plurality of rapidly advancing hammer members or other particle impacting members peripherally mounted on a high speed rotor with cooperating means to introduce the solid material to be comminuted into the path of such rapidly moving hammer members. Such solid material, usually in the form of large size particulates is conventionally fed into the hammer path by gravity or by conveyors or, in some instances, by an air stream and generally in a direction normal to the tangent to the path of displacement motion of the rotating hammer faces in order to obtain maximum velocity differentials and/or maximum energy transfer between the moving hammer faces and the material to be comminuted.

While such hammer mills are widely used for the comminution of materials, they are not particularly well adapted to efficiently effect the selective reduction of minor fractions of oversized particulates entrained in a gas borne stream of preformed or precomminuted particulate matter. While the presence of minor fractions of oversized particulate material will normally be found, in varying degree, in the output gas stream from conventional hammer mills, the presence of such oversize particulates is particularly troublesome in the processing of carbon black since such oversized particulates are there normally in the nature of undesired inpurities therein, such as scale, brick or other reaction vessel materials and/or coke particulates, and their presence results in certain problems when the carbon black product is later used in diverse physical and chemical processes.

SUMMARY OF THE INVENTION

In its broad aspects the subject invention may be considered as an improved radial flow impactor-separator unit into which a particulate material is introduced essentially tangential to and codirectionally with the direction of impact member advance such.

The codirectional flow aspect of this invention is contrary to conventional teaching. It is conventionally thought that in order to maximize impact energy it is desirable to feed such a particulate bearing gas stream in a direction normal that of impact member advance.

The present inventor has determined, however, that if the tip speed of the rotor is sufficiently greater than the speed of the gas, the losses of impact energy due to the codirectionality of the collisions are not significant. This is because the impact energy is proportional to the square of the velocity of the rotor tips minus the square of the velocity of the gas. Thus, as long as the difference between the two velocities is sufficiently larger, the energy at the locus of provides sufficient impact energy to effect communition.

In its narrower aspects, the subject invention includes a radial flow impactor-separator unit into which particulate bearing gas stream bearing a minor fraction of oversized particulate material is introduced into an impactor zone at a high velocity, as for example at 5000 at 8000 ft./min., and under turbulent flow conditions and within which zone the particle impacting surfaces are advancing at at least twice the speed fo the incoming gas stream and desirably at a minimum differential velocity therebetween of at least about 10,000 to 12,000 ft./min.

Among the advantages of the subject invention is the provision of an improved impactor-separator unit for selectively reducing the size of a minor fraction of oversized particulates entrained in a stream of gas borne particulate material and within which the available energy appears to be largely expended in the selective reduction of such oversized particulate material. A particular advantage attendant the use of the subject invention is the improvement of utility and commercial value of a carbon black product through the selective reduction of the size of oversized impurities often found therein, such as particles of brick, scale, or petroleum coke, that emanate from the reactor vessels together with the carbon black products in the exit gas stream therefrom. A corollary advantage thereto is a permitted extension of the useful life of carbon black production reactor vessels. A further advantage of the subject invention is the minimization, if not avoidance, of coatings or other undersired accumulations of the finer sized particulates, specifically carbon black, within the impactor-separator and an attendant high operational efficiency thereof.

The primary object of this invention is the provision of an improved construction for a radial flow impactor-separator device for effecting the selective comminution of minor fractions of oversized particulate material in a stream of gas borne particulates.

Another primary object of this invention is the provision of an improved construction for a radial flow impactor-separator device for effecting the selective comminution of oversized particulate material in a gas borne stream of carbon black.

Other objects and advantages of the subject invention will become apparent from the following portions of this specification and from the appended drawings which illustrate, in accord with the mandate of the patent statutes, a presently preferred construction for a radial flow impactor-separator device incorporating the principles of this invention.

Figure 1:
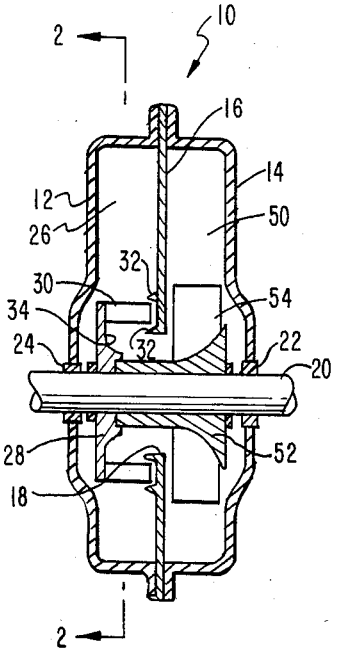
FIG. 1 is a schematic vertical sectional view of a simplified impactor-separator rotor assembly.
Figure 2:
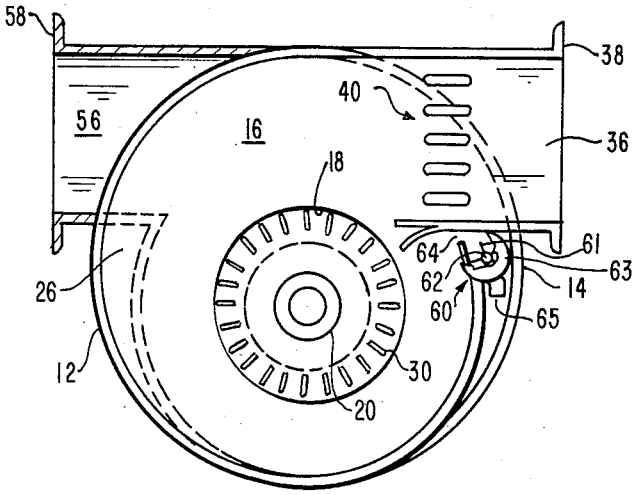
FIG. 2 is a schematic side elevational view as generally taken on the line 2—2 of FIG. 1.

Referring to the drawings and initially to FIGS. 1 and 2, there is provided a housing, generally designated 10, in the form of an entry volute shell 12 and exit volute shell 14 disposed in back to back relation and separated by a central wall 16 having a circular aperture 18 therein. As illustrated the size and contour of the entry and exit volute shells are preferably of complemental character, although both size and contour can be selectively varied in accord with the exigencies of use thereof. A drive shaft 20 is mounted in suitable shell supported bearings 22 and 24 and coaxially traverses the opening 18 in central wall 16. Mounted on shaft 20 within the entry volute chamber 26, as such is defined by volute shell 12 and central wall 16, is a rotor 28 having a plurality of hammer members 30 perpendicularly mounted on the periphery thereof. As best shown in FIG. 1, the free terminal ends of the hammer members 30 are disposed closely adjacent to the marginal facing surface of the portion of the central wall 16 defining the opening 18 therein and the path of rotative displacement thereof is peripherally bounded by a pair of outwardly extending sealing ridges or shoulders 32 thereon to minimize undesired gas and material flow past the hammer members ends. This feature is particularly aimed at minimizing the flow of large impurity particulates past the hammer member ends in avoidance of hammer member impact therewith. The surface of the rotor base 28 disposed in spaced facing relation to the openings 18 is arcuately shaped, as at 34, to enhance a selectively directed gas flow from the interior side of the hammer members 30 to and through such opening 18.

As best shown in FIG. 2 the entry volute chamber 26 is provided with a tangential inlet conduit 36 having a flanged terminal end 38 and a plurality of adjustable vanes 40 to permit control of the angle of entry of the incomings gas stream.

Also mounted on drive shaft 20 and disposed within the exit volute chamber 50, as the latter is defined by the exit volute shell 14 and the central wall 16, is a fan assembly including an arcuately contoured hub 52 and a plurality of radially mounted blade members 54. Volute chamber 50 is provided with a tangential outlet conduit 56 having a flanged terminal end 58.

As will now be apparent, an intake gas stream bearing a minor fraction of oversized particulate matter is adapted to be introduced at high velocity into the entry volute chamber 26 through intake conduit 36. The gas stream velocity and hammer member 30 velocities are of such relative magnitude as to effect selective impaction and comminution of the oversized particulates as the latter are induced to flow, together with the gas stream, through the entry volute chamber 26, the comminution zone as defined by the locus of rotative displacement of the hammer members 30, the central opening 18, the exit volute chamber 50 and the outlet conduit 56.

Unexpectedly, it has ascertained that higher efficiency of comminution and separation have been achieved when the gas stream is displaced at sufficiently high velocities as to markedly depart from laminar flow condition into highly turbulent flow conditions. As previously pointed out, the incoming oversize particulate bearing gas stream is desirably introduced into inlet conduit 36 at velocities in the order of 5000 to 8000 feet per minute under turbulent flow conditions and with the hammer members 30 being advanced at at least twice the speed of the incoming gas stream and preferably at a minimum differential velocity therebetween of about 10,000 to 12,000 ft./min. Contrary to conventional belief, the codirectionality of the gas a rotor tip velocities does not impede impact efficiency, so long as the difference between rotor tip velocity and gas stream velocity is sufficiently great. Under such conditions selective impaction and comminution of oversized particulates appears to be effected and without appreciable effect on, or energy expenditure in conjunction with a modification of the finer sized particulates being borne by such gas stream.

As previously pointed out, the subject invention appears to be possessed of particular utility in the production of a high quality carbon black product. As carbon black reactors reach a certain stage of their operating life, impurities in the form of oversized particles of scale, brick, petroleum coke and the like become entrained in the exiting gas stream bearing the desired carbon black product. Petroleum coke particles vary with the quality of the hydrocarbon feed stocks, said particles being a greater problem with Mexican, Canadian and some U.S. oil, than with the Arabian oils. In many of the intended uses of carbon black product, the presence of these undesired oversized contaminants, even when constituting a very minor constituent thereof, result in a substantial diminution of both product utility and its commercial value. Reducing the size of these impurity particles greatly increases the utility of the carbon black product.

At the narrowest portion of the intake volute 26, optional back out means, generally designated 60, may be provided. Said back out means are intended to intercept and remove particularly hard to grind particles. Said back out means may take the form of an auger like back out screw, or, as shown, may be in the form of a paddle type air lock. Paddles 61 are mounted on a cylindrical hub 62, and the assemblage thereof rotates in chamber 63. Particularly heavy particles sliding along the periphery of the volute will enter the airlock at 64, where the rotating paddles 61 will sweep the particles towards the exit at 65.

Figure 3:
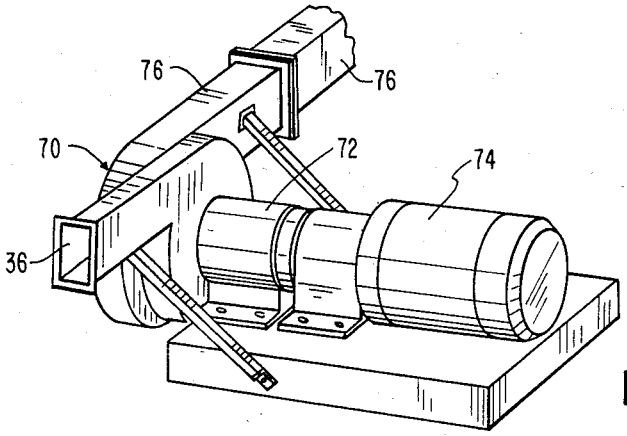
FIG. 3 is a oblique view of a presently preferred embodiment of an impactor-separator assembly incorporating the principles of this invention.
Figure 4:
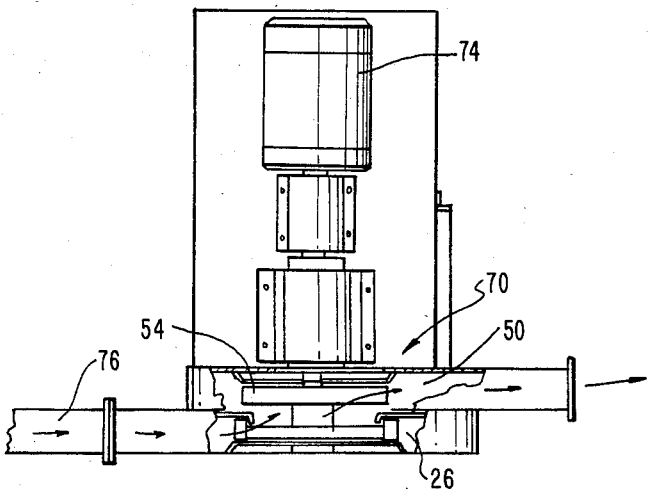
FIG. 4 is a top view, partially in section, of the assembly illustrated in FIG. 3.

Referring now to FIGS. 3 and 4, there is shown an impactor-separator assembly, generally designated 70 and of the character described above, as employed in conjunction with the effluent gas stream from a carbon black reaction, wherein the drive shaft 20 is driven, through transmission 72 by an electric motor 74, suitably a high horsepower AC motor. The exhaust duct 76 of a carbon black reactor of conventional construction (not shown) is connected to the inlet conduit 36 of the entry volute chamber 26. The incoming gas stream constitutes a multiphase fluid made up of the carbon black reactor exhaust gases and a solid phase principally constituted by finely divided carbon black particles and a minor constituent or fraction of oversized particulate contaminants primarily in the form of particles of scale, brick, coke or the like. Such effluent gas flow is moved at a high velocity, suitably in the order of 5000 to 8000 ft./min. through the duct 76 under the impetus of the positive pressure extant within the reactor exhaust system and/or the inducement of the rapidly rotating fan blades 54 in the exit volute chamber 50.

The exhaust duct 76 of the carbon black reactor is of sufficient length as for example at least about 10 feet, to permit the velocity of the entrained carbon black particles to closely approach the velocity of the gas stream by the time such particles approach the inlet conduit 36 to the entry volute chamber 26. Within the entry volute chamber 26, the gas stream assumes a more or less spiral but highly turbulent path in a direction generally concurrent to the direction of rotation of the hammer members 30. While not as yet fully understood, rotation of the hammer members 30 at a speed of at least twice that of the gas stream and desirably at a minimum speed differential of from 10,000 to 12,000 ft./min. at the locus of impact effects a selective comminution of the oversize particulates as the gas stream passes through the locus of hammer member displacement without any noticeable effect upon the main carbon black particulate constituent also being borne by said gas stream.

After passage through the locus of hammer member displacement, the gas stream and the particulate matter being carried thereby is directed through the opening 18 and, under the action of the rotating fan blades 54 and exit volute chamber 50 into an outwardly directed spiral path for discharge through outlet conduit 56 to a baghouse collector or other suitable filtering device to separate the particulate matter from the gas stream.

Having thus described my invention, I claim:

1. Apparatus for effecting a selective diminution of the size of oversized particulate material constituting a minor fraction of a quantity of finely divided particulates entrained in a moving gas stream comprising a rotor having a plurality of hammer members extending from the periphery thereof and disposed parallel to the rotor axis, each including a radially disposed and generally rectangular planar impact surface positioned parallel to the rotor axis and adapted to be displaced at a first predetermined velocity through a path of advance definitive of a locus of particle impact and comminution, a volute-shaped entry chamber disposed in surrounding relation to said rotor and to said locus of particle impact for selectively directing said gas stream and particulates entrained therein in an inwardly directed spiral flow pattern substantially coplanar with and tangentially into the path of advance of the impact surfaces of said hammer members, a volute shaped exit chamber disposed adjacent to and downstream of said locus of particle impact and in fluid communication therewith for reception and delivery of said gas stream and particulate material entrained therein after passage thereof through the locus of particle impact, means, including fan means disposed in said volute shaped exit chamber, for inducing the flow of said gas stream and particulate material entrained therein through said volute shaped chambers and through said locus of particle impact and comminution at a second predetermined velocity having a magnitude no greater than one-half that of said first predetermined velocity.

2. Apparatus as set forth in claim 1 wherein said second predetermined velocity is in the range of from about 5,000 to about 8,000 feet per minute.

3. Apparatus as set forth in claim 1 wherein said finely divided particulates comprise carbon black and said oversize particulates comprise undesired impurities therein.

4. Apparatus as set forth in claim 1 including means disposed at the narrow end portion of said volute shaped entry chamber for receiving and separating oversized particulates that are being centrifugally induced to flow adjacent to the outer wall of said volute shaped entry chamber.

5. Apparatus as set forth in claim 4 wherein said oversized particle receiving and separating means includes a paddle type airlock for particle delivery therefrom.

6. Apparatus as set forth in claim 4 wherein said oversized particle receiving and separating means includes an auger for effecting particle delivery therefrom.

* * * * *